US005715543A

United States Patent [19]

Sim

[11] Patent Number: 5,715,543

[45] Date of Patent: Feb. 10, 1998

[54] TOILET ASSEMBLY HAVING AN AUTOMATIC VENTILATION SYSTEM

[76] Inventor: Jae K. Sim, 18437 Mt. Langley St., Suite E, Fountain Valley, Calif. 92708

[21] Appl. No.: 784,807

[22] Filed: Jan. 16, 1997

[51] Int. Cl.[6] ..... E03D 9/05

[52] U.S. Cl. ..... 4/213; 4/216

[58] Field of Search ..... 4/213, 216, 217

[56] References Cited

U.S. PATENT DOCUMENTS

| | | |
|---|---|---|
| 2,227,920 | 1/1941 | Baither . |
| 2,297,935 | 10/1942 | Baither . |
| 2,329,221 | 9/1943 | Sanford . |
| 2,443,705 | 6/1948 | Fitzgerald . |
| 2,575,778 | 11/1951 | Wilson . |
| 2,817,099 | 12/1957 | Fitzgerald . |
| 2,847,682 | 8/1958 | Shay . |
| 3,495,282 | 2/1970 | Taggart . |
| 3,805,304 | 4/1974 | Ikehata . |
| 4,222,129 | 9/1980 | Baker . |
| 4,232,406 | 11/1980 | Beeghly . |
| 4,318,192 | 3/1982 | Williams . |
| 4,365,361 | 12/1982 | Sanstrom . |
| 4,494,255 | 1/1985 | Drummond . |
| 4,551,865 | 11/1985 | Waters ..... 4/213 |
| 4,865,664 | 9/1989 | Sato . |
| 5,005,222 | 4/1991 | Sim . |
| 5,054,131 | 10/1991 | Sim . |
| 5,079,782 | 1/1992 | Sim . |
| 5,167,039 | 12/1992 | Sim . |
| 5,353,443 | 10/1994 | Sim . |

*Primary Examiner*—Henry J. Recla
*Assistant Examiner*—Charles R. Eloshway
*Attorney, Agent, or Firm*—Birch Stewart Kolasch & Birch, LLP

[57] ABSTRACT

A toilet assembly having an automatic ventilation system which includes a high-powered suction member, an innovative motion sensor, a siphonic action member, and discharging member for objectional odor. While the user sits on the toilet seat ring, the objectional odor is effectively ventilated. When the user stands up and pushes a flush push button, the toilet assembly is effectively flushed.

7 Claims, 5 Drawing Sheets

TOILET ASSEMBLY HAVING AN AUTOMATIC VENTILATION SYSTEM

BACKGROUND OF THE INVENTION

1. Field of the Invention

The present invention relates to a toilet assembly having an automatic ventilation system and more particularly, a toilet assembly including a trap way, a siphon functional valve, a multifunctional tube member, an odor air valve member, and a motion sensor whereby while the user sits on a seat ring, any objectionable odor is ventilated.

2. Description of Related Art

Various types of non-siphon type ventilating toilets are generally known in the art to be utilized with a fan for ventilating contaminated air through a separate exhaust duct. Several types of non-siphon type ventilating toilets are known in the art as a European type toilet to be utilized with a gas exhaust conduit disposed adjacent to a toilet stool and connected to a sewer discharge line and a fan/motor connected to an on/off switch of a light of the toilet.

However, these toilets suffer from a number of problems:

(1) the waste product and associated objectionable odor does not clearly discharge directly to the sewer discharge line since the ventilating conduit is directly connected to the sewer discharge line;
(2) these conventional toilets are very complicated in structure, expensive to manufacture, and difficult to use;
(3) since the flush water can flow into the ventilating conduit, the amount of water and the water pressure of the flush water are minimized so that these toilets cannot effectively achieve the flushing purpose thereof; and
(4) since such toilets are utilized with a relay or an on/off switch for activation of the fan, this switch may be out of order frequently. Furthermore, such toilets may not employ the use of a water overflowing system and even if the system were used, it may be very complicated in structure and inefficient in use.

Such toilets are described in Baither, U.S. Pat. No. 2,227,920; Baither, U.S. Pat. No. 2,297,935; Sanford, U.S. Pat. No. 2,329,221; Fitzgerald, U.S. Pat. No. 2,443,705; Wilson, U.S. Pat. No. 2,575,778; Fitzgerald, U.S. Pat. No. 2,817,099; Shay, U.S. Pat. No. 2,847,682; Taggart, U.S. Pat. No. 3,495,282; Ikehata, U.S. Pat. No. 3,805,304; Baker, U.S. Pat. No. 4,222,129; Becghly et al., U.S. Pat. No. 4,232,406; Williams et al., U.S. Pat. No. 4,318,192; Sanstrom, U.S. Pat. No. 4,365,361; Drummond, U.S. Pat. No. 4,494,255; and Higgins, U.S. Pat. No. 4,865,664.

In order to avoid these problems, U.S. Pat. No. 5,005,222, issued to the present inventor, discloses a toilet assembly which includes a toilet stool having a ventilation conduit disposed adjacent to the back wall portion of the toilet stool wherein the ventilation conduit extends angularly around a siphon conduit at the point where they communicate with a sewer discharge line. A fan member is disposed in the lower portion of the ventilation conduit, and a toilet water holding tank having a motion sensor is disposed on the front exterior thereof and free of interference from the opening and closing of a toilet seat cover. A multifunctional tube having a U-shaped configuration is disposed in the toilet holding tank, and a movable ball valve is disposed to move in the multifunctional tube for allowing exhaust gas to flow from a flush ring to the ventilation conduit or flush water to flow from the toilet holding tank to the toilet bowl, whereby upon opening the toilet seat cover, while the user sits on the seat ring, the motion sensor actuates the fan member allowing the objectionable odor to be ventilated. In turn, when the user stands up and flushes the toilet assembly, the motion sensor deactivates and simultaneously the flush water discharges the waste products and associated objectionable odor directly to the sewer discharge line.

Another U.S. Pat. No. 5,079,782 issued to the present inventor, discloses a toilet assembly which includes a toilet stool having a ventilation conduit disposed adjacent to the back wall portion of the toilet stool and a gas exhaust duct connected to the ventilation conduit. The toilet assembly also has a raised portion disposed at the interior surface thereof for allowing exhaust gas to flow from a flush ring to the ventilation conduit. The raised portion is provided with a water exiting tube for preventing the flush water from the water exiting tube from flowing into the ventilation conduit, whereby the flush water discharges the waste products and associated objectionable odor directly to the sewer discharge line.

A further U.S. Pat. No. 5,054,131 issued to the present inventor, discloses a toilet assembly which includes a toilet stool having a ventilation conduit disposed adjacent to the back wall portion of the toilet stool. A U-shaped exhaust duct is disposed in the toilet holding tank and connected to the ventilation conduit for allowing exhaust gas to flow from a flush ring to the ventilation conduit, whereby the flush water discharges the waste product and associated objectionable odor directly to the sewer discharge line.

Still another U.S. Pat. No. 5,167,039 issued to the present inventor, discloses a non-siphon type ventilating toilet assembly which includes a U-shaped ventilation tube disposed in the toilet holding tank for ventilating objectionable odor from the toilet bowl. The ventilation tube contains a cap valve which moves upwardly and downwardly along an outer-screwing shaft of an upper motor and a fan of a side motor. Both motors are connected to a motion sensor, whereby upon opening the toilet seat cover having a sensor aperture and sitting by the user on the seat ring, the motion sensor actuates, allowing both motors to be operated. Simultaneously, the motors open the cap valve so that the objectionable odor is ventilated. In turn, when the user stands up and flushes the toilet assembly, the motion sensor deactivates, allowing both motors to be stopped and simultaneously closing the cap valve and the flush water discharges the waste products to the sewer discharge line.

Yet another U.S. Pat. No. 5,353,443 issued to the present inventor, discloses a toilet assembly having a combined automatic ventilation and flushing system, which comprises a returnable solenoid member, a trap way, a trap way valve member, a multifunctional tube member, and a motion sensor. While the user sits on the toilet seat ring, the objectionable odor is effectively ventilated and when the user stands up, the toilet assembly is automatically flushed.

However, these toilet assemblies do not achieve a perfect discharge of the objectionable odor and are somewhat complicated in construction. In addition, these toilet assemblies do not disclose or suggest the use of a seesaw valve member of an automatic ventilation system.

SUMMARY OF THE INVENTION

Accordingly, it is an object of the present invention to provide an improved toilet assembly having a combined automatic ventilation and flushing system whereby objectionable odor from the toilet bowl is effectively flushed and ventilated therefrom, and discharged into a sewer discharge line, which eliminates the above problems encountered in a conventional toilet assembly.

Another object of the present invention is to provide a siphon-type toilet assembly which includes a large odor air valve and a large motor fan whereby the objectionable odor is effectively ventilated and noise of the motor fan can be readily reduced.

A further object of the present invention is to provide a toilet assembly which does not include a separate air conduit so that the ventilation of the toilet assembly of the present invention is effectively performed and is fully legal with the plumbing code.

Still another object of the present invention is to provide an improved toilet assembly having an automatic ventilation system, which includes a high powered member, a motion sensor, a siphonic action member, an odor air valve member, and a discharging member for unpleasant odor, whereby upon opening the toilet seat cover, while the user sits on the seat ring, the motion sensor is actuated for triggering an electromagnet and opening an odor air valve so that the unpleasant odor is ventilated, and in turn, when the user stands up and pushes a flush push button, the motion sensor is deactivated for enabling a closing of the odor air valve and simultaneously, so that the flush water discharges the waste products to the sewer discharge line.

Yet another object of the present invention is to provide a ventilation toilet assembly which further comprises a water overflow ball valve movable in a net chamber disposed at the top area of an L-shaped upward tube for allowing water to discharge thereinto upon overflowing of the flush water.

Still another object of the present invention is to provide a toilet assembly which is simple in structure, inexpensive to manufacture, durable in use, and refined in appearance.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a toilet assembly having an automatic ventilation system, which comprises a high-powered suction member, an innovative motion sensor, a siphonic action member, and discharging member for objectionable odor whereby while the user sits on the toilet seat ring, the objectionable odor is effectively ventilated and when the user stands up and pushes a flush push button, the toilet assembly is effectively flushed.

BRIEF DESCRIPTION OF TEE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
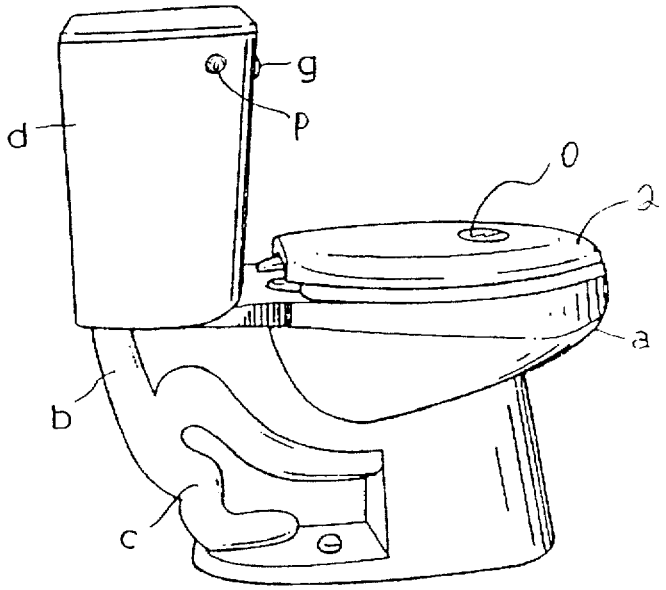
FIG. 1 is a perspective view of the toilet assembly having an automatic ventilation system according to the present invention.
Figure 2:
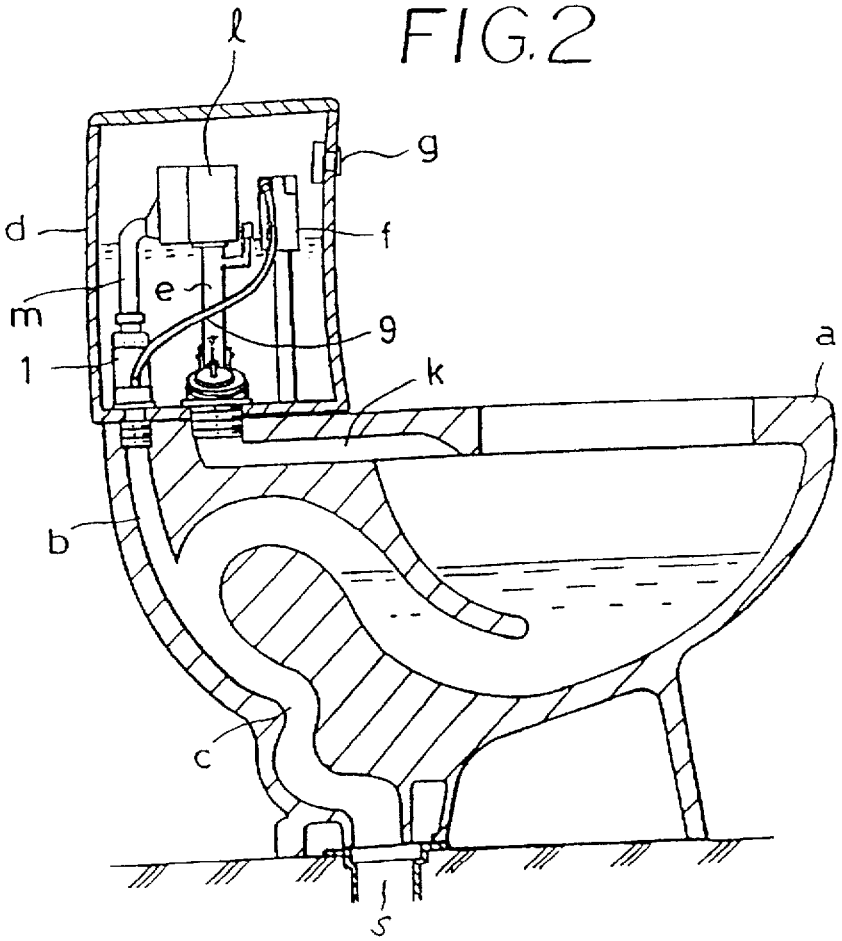
FIG. 2 is a sectional view of FIG. 1.
Figure 4:
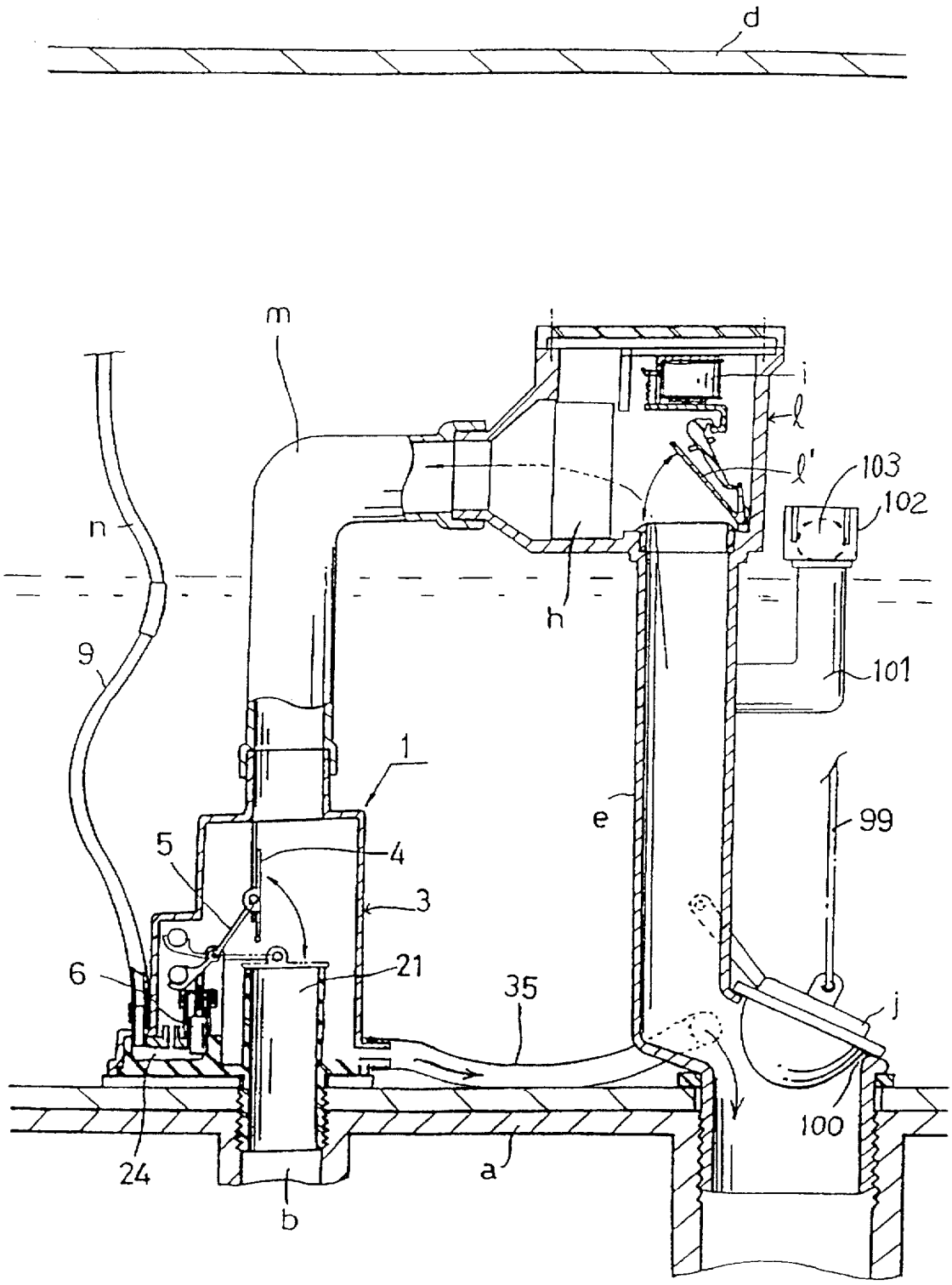
FIG. 4 is a sectional view of the siphon functional valve member, a refill tube, a multifunctional tube, an odor air valve member, and a water overflowing member of the toilet assembly according to the present invention.

Referring now in detail to the drawings for the purpose of illustrating preferred embodiments of the present invention, the toilet assembly having an automatic ventilation system as shown in FIGS. 1, 2, and 4, includes a toilet stool (a), a toilet water holding tank (d), a multifunctional tube member (e) and a siphon functional valve member 1 disposed in the toilet water holding tank (d), a motion sensor member (g) disposed on the front exterior of the toilet water holding tank (d), and an odor air outlet way (b) and a trap way or a siphon passage (c) disposed in the toilet stool (a).

The toilet stool (a) includes a toilet bowl as described in FIGS. 1 and 2 of U.S. Pat. No. 5,353,443 issued by the present inventor, having a main tunnel (k) disposed at the upper portion of the toilet bowl for allowing fresh flush water to be flushed into the toilet bowl and odor air to be transported to the multifunctional tube member 3, and a seat ring operatively located on the top of the toilet bowl. The toilet stool (a) further includes a toilet seat cover (Q) having a sensor window (O) operatively located on the seat cover with the toilet seat cover being pivotally connected to the seat ring by pivotal hinges for transmitting a sensor beam through the sensor window (O). The trap way (c) such as a siphon passage is disposed in the toilet bowl and communicates with the multifunctional tube for discharging waste products and associated objectionable odor directly from the toilet bowl to a sewer discharge line (s).

As shown in FIG. 4, the toilet water holding tank (d) contains the water to be flushed into the toilet bowl through a main tunnel of the toilet stool (a). The toilet water holding tank (d) includes a water supply tube (f) connected to a water supply line through a water intake valve disposed at the bottom end thereof and a float valve disposed at the top end thereof, a float member (not shown) connected to the float valve through a rod as described in FIGS. 1 and 2 of U.S. Pat. No. 5,353,443 issued by the present inventor. The toilet water holding tank (d) further includes an L-shaped upwardly oriented tube 101 for allowing a discharge of overflowing flush water from the toilet water holding tank (d) and a refill tube (n) connected to the siphon functional valve member 1, a flush push button (p) disposed on the side exterior of the toilet water holding tank (d) for connection to a flapper valve button and a pair of chains. The water supply tube (f) stands upright within the toilet water holding tank (d).

As shown in FIG. 4, the multifunctional tube member (e) includes a vertical main tube supported by and depending on the bottom of the toilet water holding tank (d), and the L-shaped upwardly oriented tube 101 extending from the middle wall of the other side of the vertical main tube.

Figure 3:
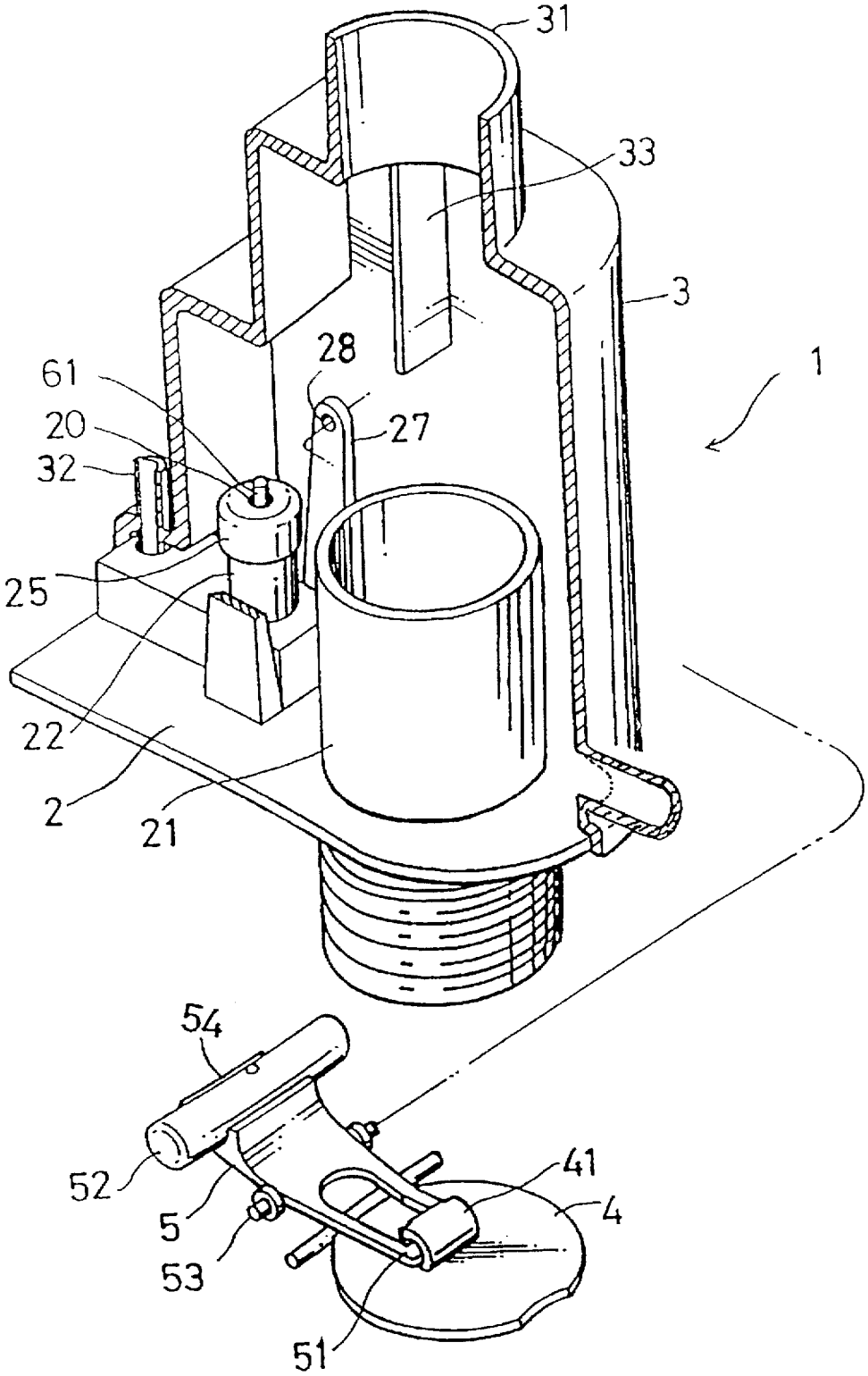
FIG. 3 is an exploded perspective view of a siphon functional valve member of the toilet assembly according to the present invention containing cut-away portions in order to illustrate the construction of the toilet assembly of the present invention.

As shown in FIG. 4, the odor air valve member (l) is described in FIGS. 3 and 4 of U.S. Pat. No. 5,353,443 issued by the present inventor. The odor air valve member (l) of the multifunctional tube member (e) includes an electromagnet (i) operatively associated with a C-shaped contacting plate to be attached to the electromagnet (i) when the electromagnet (i) is activated by the motion sensor member (g). The odor air valve member (l) also includes a lever inwardly hooked at both ends, and an odor air valve door (l') having an odor air valve handle for operatively connecting with one end of the hooked lever so as to open the odor air valve plate (l'). The lever is easily pivoted about a first pivot pin pivotally supported by a pivot pin support of the odor air valve member (l).

As shown in FIGS. 1 and 2, the motion sensor member (g) is disposed on the front exterior of the toilet water holding tank (d) in the middle portion of the front exterior thereof in alignment with the sensor window (O) of the toilet seat cover (Q). The motion sensor member (g) includes a sensor box containing the motion sensor connected to the electrical wire and an indicator light as described in U.S. Pat. No. 5,353,443 issued by the present inventor. Also, the motion sensor is not an on/off type switch or relay type switch so that the motion sensor member (g) is durable when compared with the switch of the conventional vented toilet assemblies.

Furthermore, since the toilet seat cover disposed over the seat ring has the sensor window (O) the motion sensor is free of interference from the opening and closing of the toilet seat cover (Q). The motion sensor is connected to the 12 volt electrical source through electrical wires.

Also, the motion sensor actuates a fan motor (h) to be operated while the user sits on the seat ring upon opening the toilet seat cover (Q), and in turn the motion sensor deactivates when the user stands up.

That is, when the motion sensor is actuated, the electromagnet (i) actuates, the odor air valve door (l') opens and simultaneously, the fan motor (h) and the fan disposed within a fan motor housing operates, the odorous air or exhaust gas flows to an L-shaped downward odor air pipe (m), the siphon functional valve 1, the trap way (c) and a sewer discharge line (s) through the odor air outlet way (b).

As shown in FIGS. 3 and 4, the siphon functional valve member 1 includes a main body 2 and a valve housing 3 for covering the siphon functional valve member 1. The main body 2 contains an odor air outlet tube 21 communicated with the odor air outlet way (b), a vertical piston cylinder 22 disposed vertically parallel with an upright tube 32 and the odor air outlet tube 21 and supported thereon, a pair of vertical supports 27 disposed vertically parallel within and around the piston cylinder 22, and a seesaw member 5.

As shown in FIG. 3, the seesaw member 5 has the odor air valve plate 4 pivotally attached to one end 51 thereof at a knob 41 of the valve plate 4 for opening and closing the odor outlet tube 21, a pair of pivotal center pins 53 pivotally connecting to a pair of apertures 28 disposed in the tops of the pair of vertical supports 27, and a weight rod 52 attached to the other end 54 thereof.

Figure 5:
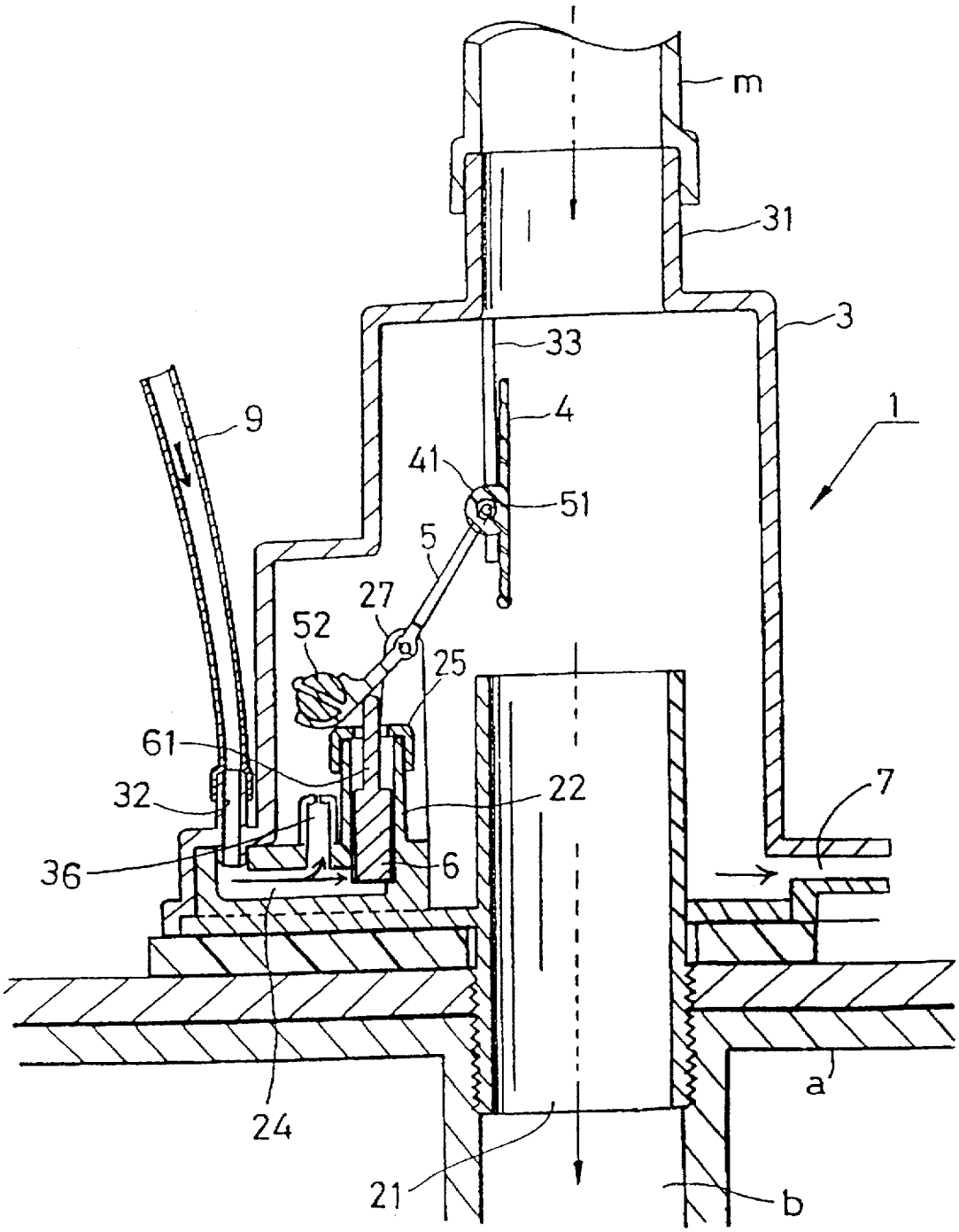
FIG. 5 is a sectional view of the siphon functional valve member of the toilet assembly according to the present invention in an open position thereof.
Figure 6:
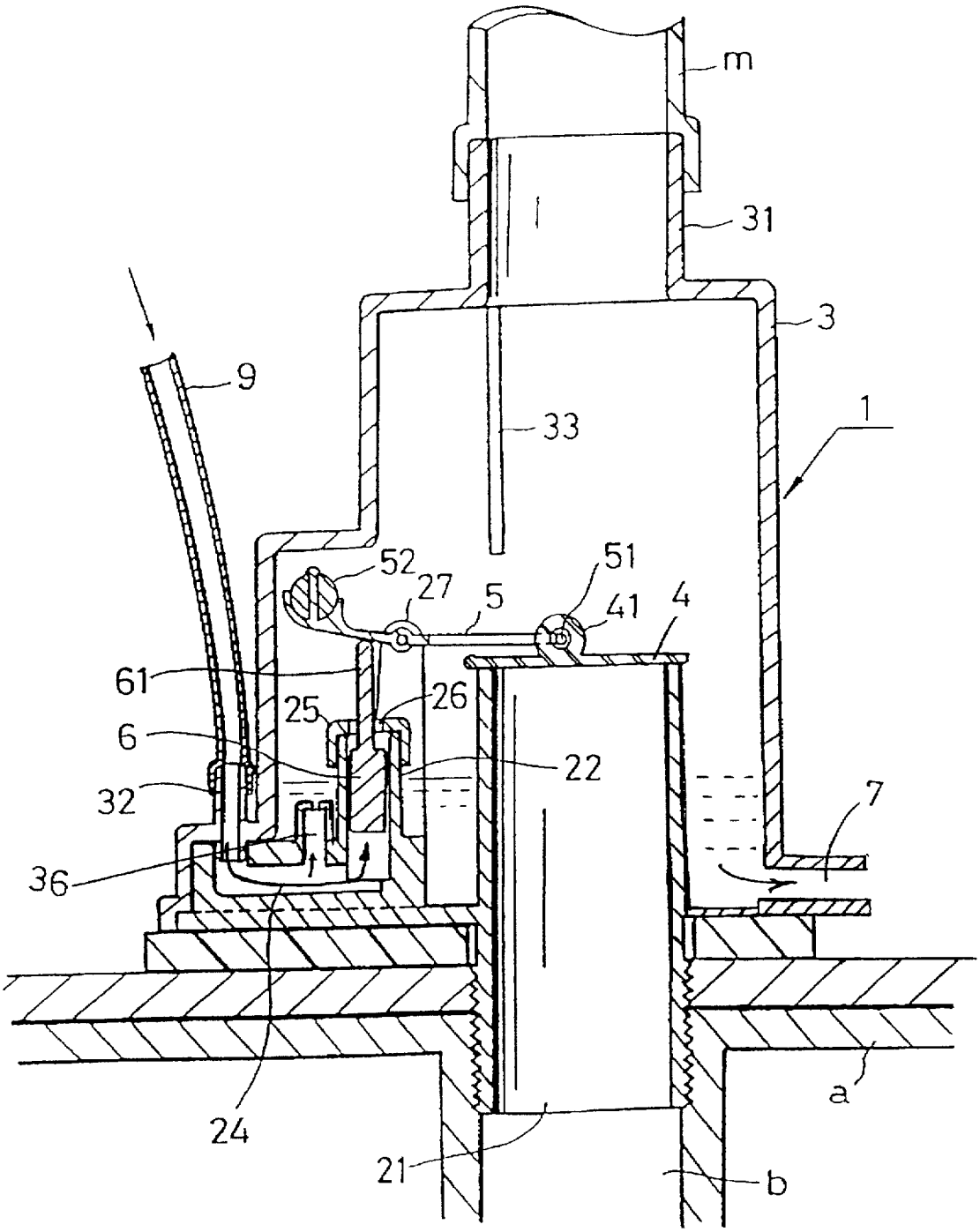
FIG. 6 is a sectional view of the siphon functional valve member of the toilet assembly according to the present invention in a closed position thereof.

As shown in FIGS. 4, 5, and 6, the vertical piston cylinder 22 contains a cap 25 having a piston hole 20, a piston body 6, and a piston 61 supported on the piston body 6 and passed over the piston hole 20, and is provided with a water channel 24 communicated therewith and communicated with the refill tube (n) through a refill hose 9 and an upright tube 32. Also, an extra water outlet 36 is communicated with the water channel 24 for discharging excess water in the water channel 24 after pushing up the piston 61 by water pressure of water in the channel 24. The water from the piston hole 20 and the extra water outlet 36 are drained into the multifunctional tube (e) through a water outlet 7 and a drain hose 35 (FIG. 4).

Therefore, when the user pushes the flush push button (P), the water supplies from the water supply tube member (f) to the refill tube (n), and the water flows to the refill hose 9 and the upright tube 32, and to the water channel 24. Thereafter, the water pressure pushes the piston body 6 and the piston pushes the weight rod 52, so that, the valve plate 4 is closed by the seesaw principle of the seesaw member 5 (FIG. 6) for closing the odor air outlet way (b) so as to allow the strong siphonic action. However, when the water is not supplied to the water channel 24, the weight rod 52 falls down since the water pressure cannot support the weight rod 52, so that the valve plate 4 is opened as shown in FIGS. 4 and 5 for discharging objectionable odor from the toilet stool (a) through the multifunctional tube (e) and the L-shaped downward odor air pipe (m).

As shown in FIG. 5, when the valve plate 4 is opened the valve plate 4 is stopped by a stopper 33 of the trap way valve housing 3 for smoothly allowing the objectionable odor from the L-shaped downward odor air pipe (m) through an air inlet 31 of the trap way valve housing 3.

As shown in FIG. 4, a flapper valve (j) easily opens an inclined inlet 100 by pushing the flush push button (p) disposed on the side exterior of the toilet water holding tank (d) because the flapper valve (j) is connected to the flush push button (p) through a chain 99.

As shown in FIG. 4, the L-shaped upward tube 101 is provided with a net ball cap 102 disposed at the top thereof for housing a water overflow ball valve 103 so as to allow a discharge of overflowing flush water from the toilet water holding tank (d) thereto by floating the water overflow ball valve 101 as described in U.S. Pat. No. 5,005,222 issued by the present inventor.

As shown in FIG. 2, the motion sensor (g) includes a sensor box containing the motion sensor connected to the electrical wire and an indicator light. Furthermore, since the toilet seat cover (Q) disposed over the seat ring has the sensor window (O), the motion sensor is free of interference from the opening and closing of the toilet seat cover (Q). The motion sensor is connected to the 12 volt electrical source (not shown) through the electrical wires. The motion sensor actuates for allowing the fan motor (h) to be operated while the user sits on the seat ring upon opening the toilet seat cover (Q) and in turn the motion sensor deactivates when the user stands up.

According to the present invention, the toilet assembly operates as follows. First of all, upon opening the toilet seat cover (Q), while the user sits on the seat ring, the motion sensor member (g) activates for allowing the electromagnet (i) to be actuated and simultaneously the electromagnet (i) pulls the connecting plate up. Therefore, the odor air valve door (l') is open (FIG. 4).

At that time, the motor fan (h) actuates by sensing from the motion sensor of the motion sensor member (g). Also, the valve plate 4 is in an open position by action of the seesaw member 5.

Accordingly, the objectionable odor is evacuated from the toilet bowl through a plurality of openings, and the main tunnel is ventilated into the vertical main tube and is ventilated into the trap way (c) through the multifunctional tube (e), the L-shaped downward odor air pipe (m) and the trap way valve member 1, and discharged to the siphon passage (c) and then the objectionable odor is directly discharged to the sewer discharge line (s) as shown in FIGS. 4 and 5. Also, at that time, since the flapper valve (j) continuously maintains a closed state, the flush water does not interfere so that the objectionable odor is effectively ventilated.

In turn, when the user stands up and pushes the flush push button (p), the motion sensor is in an off-position for ventilation, so that the electromagnet (i) deactivates and the contacting plate moves down to tightly close the valve door (l') against the top opening of the multifunctional tube (e). At this time, the flush water effectively discharged the waste product and associated objectionable odor directly to the sewer discharge line (s) through the trap way (c).

Also, at this time, the fresh water flows to the refill tube (n), the refill hose 9, the upright tube 32, and the water channel 24. Thereafter, the fresh water flows to the piston cylinder 22 and the excess fresh water flows to the extra water outlet 36. Therefore, the piston 61 moves up and pushes the weight rod 52 of the seesaw member 5, so that the valve plate 4 is in a tightly closed state (FIG. 6). Accordingly, the toilet assembly of the present invention becomes a siphon-type.

Thus, the toilet assembly of the present invention is simple in construction, compact for portability, inexpensive to manufacture, durable in use, and refined in appearance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toilet assembly having an automatic ventilation system, said toilet assembly comprising:

a toilet stool including a toilet bowl, a water flush pipe communicating with said toilet bowl for allowing flush water to be flushed into the toilet bowl, a seat ring disposed on said toilet bowl;

a toilet seat cover disposed on the peripheral top of said toilet seat ring;

a sensor window disposed on said toilet seat cover for transmitting a sensor beam through said sensor window; and a trap way disposed within said toilet bowl for discharging waste products and associated objectionable odor directly from the toilet bowl to a sewer discharge line;

a toilet water holding tank including a water supply valve, a flapper valve, and a refill hose connected to said water supply valve;

a multifunctional tube member disposed in said toilet water holding tank and communicating with said toilet bowl and said flapper valve at a low end and connected to an odor air valve member at an upper end thereof, said odor air valve member containing an opening, an electromagnet, a valve door operatively connected to said electromagnet, a fan motor having a fan, and an L-shaped downward odor air pipe communicating with said fan motor;

a siphon functional valve member connected to said L-shaped downward odor air pipe at an opening thereof, said siphon functional valve member adapted to be connected to said sewer discharge line, said siphon functional valve member including, a valve housing, a main body disposed within said valve housing, said main body containing an odor air outlet tube communicating with an odor air outlet way, a piston cylinder having a piston, a seesaw member having an odor air valve plate for opening and closing said odor air outlet tube, and an upright tube connected to said refill tube and communicating with said piston cylinder;

a flush push button supported on the exterior of said toilet water holding tank and connected to said flapper valve whereby when a user pushes the flush push button, the flush push button lifts the flapper valve for flushing the toilet assembly; and a motion sensor disposed on the front exterior of said toilet water holding tank, said motion sensor being operable independently of opening and closing of the toilet seat cover due to said sensor window in said toilet seat cover, whereby when the toilet seat cover is open and while the user sits on the seat ring, the motion sensor actuates for ventilation and operation of the electromagnet so that the valve door of said odor air valve member is open, and simultaneously the fan motor and fan operate for ventilating the objectionable odor through the opened odor air valve and odor air outlet tube to the sewer discharge line through the odor air outlet way and the trap way, and when the user stands up and pushes the flush push button, the motion sensor deactivates for closing the opening of the multifunctional tube member by the valve door, and simultaneously the piston of said siphon functional valve member moves up by water pressure from the refill tube closing the odor air valve plate so that the flush water discharges waste products directly to the sewer discharge line through the trap way.

2. The toilet assembly of claim 1, wherein the piston cylinder is disposed vertically parallel with the upright tube and the odor air outlet tube is supported on the main body, said piston cylinder including a cap having a piston hole, and a piston body, said piston supported on said piston body and communicating with said piston hole, said piston cylinder provided with a water channel communicating therewith and communicating with said refill hose through said upright tube, and an extra water outlet communicating with said water channel for discharging excess water from the water channel after pushing up said piston by water pressure in the channel.

3. The toilet assembly of claim 2, wherein the valve housing of the siphion functional valve member includes a water outlet for draining collected water from the extra water outlet and is provided with a water drain hose connected to the water outlet thereof for draining the collected water to the low end of the multifunctional tube member.

4. The toilet assembly of claim 1, wherein said seesaw member is pivotally supported by a pair of vertical supports disposed adjacent to the piston cylinder, a pair of pivotal center pins pivotally connected to a pair of apertures disposed in top portions of the vertical supports, and a weight rod attached to an end of said seesaw member.

5. The toilet assembly of claim 1, wherein said motion sensor is provided with a sensor box, at least part of the motion sensor being attached to the front exterior of the toilet water holding tank.

6. The toilet assembly of claim 1, wherein said multifunctional tube member is provided with an L-shaped upward tube connected to the lower portion thereof, said L-shaped upward tube including a ball seat disposed at the top portion thereof for containing a water overflow ball valve so as to discharge overflowing flush water from the toilet water holding tank to the toilet stool.

7. The toilet assembly of claim 6, wherein said ball seat is provided with a net ball cap supported by said ball seat for allowing movement of said water overflow controlling ball valve between the net ball cap and the ball seat.

* * * * *